US005567579A

United States Patent [19]

Gourlaouen et al.

[11] Patent Number: 5,567,579

[45] Date of Patent: Oct. 22, 1996

[54] PHOTOGRAPHIC PRODUCT COMPRISING A BLEND OF EMULSIONS WITH DIFFERENT SENSITIVITIES

[75] Inventors: Luc R. Gourlaouen, Givry; Gerard A. D. Friour, Chalon-sur Saone; Didier J. Martin; Philippe Strauel, both of Givry, all of France

[73] Assignee: Eastman Kodak Company, Rochester, N.Y.

[21] Appl. No.: 431,393

[22] Filed: Apr. 28, 1995

Related U.S. Application Data

[63] Continuation of Ser. No. 213,320, Mar. 15, 1994, abandoned.

[30] Foreign Application Priority Data

Apr. 2, 1993 [FR] France ..... 93 04146

[51] Int. Cl.[6] ..... G03C 1/005; G03C 1/494

[52] U.S. Cl. ..... 430/567; 430/564; 430/495.1

[58] Field of Search ..... 430/495, 564, 430/567, 379

[56] References Cited

U.S. PATENT DOCUMENTS

| | | | |
|---|---|---|---|
| 3,737,317 | 6/1973 | Nicholas et al. | 430/505 |
| 3,923,515 | 12/1975 | van Stappen | 430/396 |
| 3,942,986 | 3/1976 | Florens | 430/567 |
| 3,989,527 | 11/1976 | Locker | 430/567 |
| 4,446,228 | 5/1984 | Honda et al. | 430/567 |
| 4,599,302 | 7/1986 | Scheerer | 430/509 |
| 4,617,259 | 10/1986 | Ogawa et al. | 430/509 |
| 4,639,410 | 1/1987 | Mochizuki et al. | 430/567 |
| 4,656,122 | 4/1987 | Sowinski et al. | 430/505 |
| 4,672,026 | 6/1987 | Daubendiek | 430/567 |
| 4,689,292 | 8/1987 | Metoki et al. | 430/567 |
| 4,755,449 | 7/1988 | Inoue et al. | 430/267 |
| 4,865,964 | 9/1989 | Newmiller | 430/569 |
| 4,917,996 | 4/1990 | Matsuzaka et al. | 430/569 |

FOREIGN PATENT DOCUMENTS

| | | |
|---|---|---|
| 0083239 | 12/1982 | European Pat. Off. . |
| 0063962 | 1/1987 | European Pat. Off. . |
| 63-259650 | 10/1988 | Japan . |

*Primary Examiner*—Geraldine Letscher
*Attorney, Agent, or Firm*—Paul A. Leipold

[57] ABSTRACT

The present invention concerns a photographic product containing at least one light-sensitive layer consisting of a blend of silver halide emulsions.

The blend of the invention is formed by at least one pure bromide emulsion, the proportion of fast emulsion grains in the blend is less than 50% compared with the total number of silver halide grains, and the proportion of slow emulsion grains in the blend is greater than 20%.

The present invention makes it possible to obtain a radiation-sensitive photographic product which has improved sensitivity and granularity.

23 Claims, No Drawings

PHOTOGRAPHIC PRODUCT COMPRISING A BLEND OF EMULSIONS WITH DIFFERENT SENSITIVITIES

This is a continuation of application Ser. No. 08/213,320 filed Mar. 15, 1994, now abandoned.

FIELD OF THE INVENTION

The present invention concerns a photographic product comprising at least one light-sensitive layer consisting of a blend of silver halide emulsions.

BACKGROUND OF THE INVENTION

Photographic emulsions are sensitive to light because of the presence of silver halide grains with different sizes, structures or compositions. The size of the silver halide grains is directly related to the sensitivity of the photographic emulsion obtained. In fact, the larger the silver halide grains making up the photographic emulsions, the more sensitive are the latter.

However, emulsions with large grains have a higher granularity than fine-grain emulsions. There is therefore a predictable relationship between photographic sensitivity and granularity. It has been possible to determine empirically that whenever the sensitivity of an emulsion is increased twofold, an increase in granularity of 7 to 10 units is obtained.

Polydisperse emulsions which have a normal grain size distribution curve offer a good compromise, which enables sensitive emulsions to be obtained whilst retaining low granularity. Such emulsions can be obtained directly by precipitating silver halide grains, or by mixing monodisperse emulsions of different mean sizes. This technique of mixing monodisperse emulsions enables emulsions to be obtained with a particularly reproducible polydispersity.

Photographic products comprising at least one blend of photographic emulsions with different sensitivities are described in the prior art. For example, U.S. Pat. No. 4,689,292 describes such a light-sensitive photographic product having high sensitivity and good covering power.

The products described in the aforesaid patent comprise at least one silver halide emulsion where the size distribution curve for the grains making up the emulsion has at least two peaks separated by 0.1 to 0.3 μm, that is to say the photographic emulsion consists of at least two populations of silver halide grains having mean grain sizes which differ by at least 0.1 μm and no more than 0.3 μm. These emulsions are spectrally sensitized by particular spectral dyes affording sensitization of the orthochromatic type. This emulsion may be obtained from polydisperse and/or monodisperse emulsions. This emulsion may be utilized in a single layer or in different superimposed layers. In the examples illustrating U.S. Pat. No. 4,689,292, the emulsions used are obtained from blends of polydisperse and/or monodisperse emulsions with a core and a shell, referred to as "core-shell emulsions", containing at least 20% iodide in the core. The emulsions obtained have improved speed and better resistance to pressure, and the photographic products comprising this blend of photographic emulsions are preferably used in medical radiography.

European Patent Application 83239 describes a color photographic product formed by several layers of light-sensitive photographic emulsions. These sensitive layers are such that at least 80% of the total number of silver halide grains in the product have a mean grain size larger than 0.8 μm or smaller than 0.65 μm. These silver halide grains of different sizes may be situated in the same photographic layer or in different layers. The emulsions used are polydisperse emulsions or blends of monodisperse emulsions with different mean grain diameters. In the description in this European patent application, it is mentioned that the composition of the silver halide grains constituting the blends does not represent a limiting factor in the invention. However, the emulsions of the blend which are preferred and described in the examples have identical compositions and are formed by silver bromoiodide grains containing 4% iodide. In the examples described in Tables 1 and 3, it can be seen clearly that the photographic emulsions, in which at least 80% of the total number of silver halide grains have a mean grain size larger than 0.8 μm or smaller than 0.65 μm, have improved sharpness and granularity compared with a polydisperse emulsion comprising a distribution of grain sizes outside the range claimed. However, the speed of each of the blends of emulsions of the invention lies between the speed of the most sensitive emulsion and the sensitivity of the least sensitive emulsion.

European Patent Application 63962 describes a color photographic product comprising one or more layers of silver halide emulsions formed by at least two monodisperse emulsions having mean grain sizes of between 0.2 and 3.0 μm. The size distribution curve for the silver halide grains has two peaks separated by at least 0.3 μm. The silver halide photographic product obtained is a high-speed photographic product having improved granularity. The mean size of the grains in the monodisperse emulsions used is preferably between 0.5 and 1.4 μm. The grains constituting the monodisperse emulsion or emulsions in the patent EP 63962 may consist of one or more silver halides. However, it is preferred to use silver bromoiodide or bromochloride grains in which the silver bromide is the main constituent of the silver halide grains. In the examples, the emulsions used are silver bromoiodide emulsions containing 2% silver iodide.

The monodisperse emulsions described above may be used in different layers or in a blend in one and the same layer. In Table 1 in EP 63962, it can be seen clearly that the granularity of a blend of emulsions with tabular monodisperse bromoiodide grains is improved compared with the granularity of the control emulsion, which in this case is a polydisperse bromoiodide emulsion with tabular grains.

U.S. Pat. No. 3,989,527 describes a photographic product comprising at least one radiation-sensitive layer. This radiation-sensitive layer contains silver halide grains which are surface-sensitized by a spectral sensitizer. These grains are intimately mixed with silver halide grains with a mean grain diameter of between 0.15 and 0.5 μm and which are not spectrally sensitized. These grains which are not spectrally sensitized enable the exposure radiation to be reflected. These grains, known as "reflecting grains", represent at least 1% by weight of the total silver halide grains. The reflecting grains preferably form a monodisperse population. Their size will be chosen as a function of the wavelength of the exposure radiation. These emulsions, consisting of spectrally sensitized silver halide grains and reflecting grains, offer an increase in speed without degradation of the granularity. In the examples in the patent, the reflecting grains are monodisperse pure bromide grains (0.48 μm) with a cubic structure. These grains, which are neither chemically nor spectrally sensitized, are insensitive to the exposure radiation of the product.

U.S. Pat. No. 4,865,964 describes a photographic product comprising a blend of bromide or bromoiodide emulsions having tabular grains with a high aspect ratio and bromide or bromoiodide emulsions having tabular grains with a low aspect ratio. This blend of emulsions makes it possible to obtain an advantage with regard to speed and granularity when the photographic speeds of each of the emulsions making up the blend are relatively close together.

As is shown by the prior art described above, the blends of emulsions are often used for improving the sensitometric properties of photographic emulsions. Indeed, the granularity of a blend of emulsions can be reduced in a predictable manner by substituting, for some of the coarse grains making up the blend, grains of smaller sizes, since the granularity of a photographic image is directly related to the size of the silver halide grains in the emulsion. In such case, the speed of the blend is between the speed of the slow emulsion and the speed of the fast emulsion.

In addition, it is known that the speed of a photographic emulsion can be increased by increasing the size of the silver halide grains, which necessarily increases the granularity.

In all the patents described above, the blends of emulsions are obtained from monodisperse silver halide emulsions with different sensitivities, without any particular conditions with regard to the silver halide composition of these emulsions.

PROBLEM TO BE SOLVED BY THE INVENTION

There is a continuing need to form photographic elements that have increased sensitivity without also having increased grain.

SUMMARY OF THE INVENTION

The photographic product of the invention comprises at least one sensitive layer formed by a blend of monodisperse silver halide emulsions comprising at least one fast emulsion and at least one slow emulsion, and it is characterised in that (1) at least one emulsion making up the blend is a pure bromide emulsion, (2) the proportion of fast emulsion grains in the blend is less than 50% based on the total number of silver halide grains, and (3) the proportion of slow emulsion grains in the blend is greater than 20%.

ADVANTAGEOUS EFFECT OF THE INVENTION

The invention provides a photographic element having improved sensitivity while also having a low grain. The present invention makes it possible to obtain a radiation-sensitive photographic product which has improved speed and granularity. The present invention offers a means for producing a photographic product having a predetermined sensitometric curve.

DETAILED DESCRIPTION OF THE INVENTION

In the remainder of the description, the term "fast emulsion" designates the emulsion in the blend which has the highest speed, and the term "slow emulsion" designates the emulsion in the blend which has the lowest speed.

According to the present invention, the use of a pure bromide emulsion in a blend of several emulsions makes it possible to increase the speed of the blend in a surprising manner. Indeed, such blends have a sensitivity very close to the fast emulsion in the blend, even when the proportion of the fast emulsion in the blend is as small as 5%. Moreover, this increase in the sensitivity of the blend is obtained without degrading the granularity.

The blend of emulsions may contain, in addition to a slow emulsion and a fast emulsion, one or more emulsions having speeds lying between the speed of the fast emulsion and the speed of the slow emulsion as defined above and which make up the blend. In the remainder of the description, these emulsions will be referred to as "medium emulsions".

The difference in speed between any two emulsions of the blend having the nearest sensitivities is preferably such that extended latitude in the photographic element is achieved without an appreciable distortion of the shape of the sensitometric curve. This difference in speed should be within the range of from about 0.2 to about 1 Log E (E being exposure).

In the two types of emulsion blend described above (a blend with two constituents or a blend with more than two constituents), the proportion of grains of the fastest emulsion is smaller than the proportion of grains of the slowest emulsion. More particularly, with a blend with two emulsions, the proportion of grains of the fast emulsion is less than 40%. With a blend comprising more than two emulsions, the proportion of grains of the fast emulsion is less than 20%.

According to the invention, the emulsions in the blend are monodisperse emulsions. The size of these emulsions is determined by volumetric analysis of the silver halide grains, which is carried out by electrolytic reduction. Such a method is described by A. Holland and A. Feinerman in J. Applied Photo. Eng. 8, 165 (1982). This method enables the volume distribution of the grains to be obtained. From this distribution, it is possible to calculate, by means of the following formulae, the mean volume of the grains (V) as well as the equivalent spherical diameter (ESD) and standard deviation ($\sigma$), $V_i$ being the volume of a given grain and N the number of grains counted.

$ESD=2(3V/4\pi)^{1/3}$ in micrometers $$\sigma=[(\Sigma(V_i-V)^2/N)]^{1/2}$$

The coefficient of variation (COV) being defined by the formula:

$$COV=100\ \sigma/v$$

In the present invention, it is preferred to use emulsions with a coefficient of variation (COV) of less than 25%, and preferably less than 20%.

The mean equivalent diameter of the grains in each of the emulsions making up the blend is between 0.2 and 1.5 μm. The mean equivalent diameter of the grains in each of these emulsions will be chosen according to the desired sensitivity.

In general terms, the sensitivity of an emulsion depends on the size of the silver halide grains which make it up. However, it is possible, by optimizing the chemical and/or spectral sensitization of a photographic emulsion, to obtain an emulsion with a greater sensitivity than an emulsion consisting of silver halide grains of larger size which has not been optimally sensitized.

The silver halide grains in the emulsions in the blend other than the pure bromide emulsion may have different compositions. It is possible, for example, to use silver bromide, silver iodobromide, silver chloride, silver chloroiodide or silver chlorobromoiodide grains. The silver halide grains may be spherical, cubic, octahedral, or cubo-octahedral. When the emulsions contain several silver halides, the different silver halides may be distributed in the grains homogeneously or in such a way as to form a stratiform structure, such as, for example, emulsions with a core and shell referred to in the remainder of the description as "core/shell emulsions". These emulsions may also be formed by silver halide grains on which has been effected an epitaxial deposition of a silver halide different from the silver halide forming the grains.

According to one embodiment, the emulsions other than the pure bromide emulsion are bromoiodide emulsions. In the majority of cases, it is considered that it is possible to use iodide contents of between 0.5 and 20% molar compared with the total silver content, iodide contents of between 1 and 12% molar compared with the total silver content giving optimum results in the majority of photographic applications.

The photographic products according to the present invention, when they are intended for color photography, generally comprise a support having thereon at least one layer of blue-sensitive silver halide emulsion with which is associated a yellow dye forming coupler, at least one layer of green-sensitive silver halide emulsion with which is associated a magenta dye forming coupler, and at least one layer of red-sensitive silver halide emulsion with which is associated a cyan dye forming coupler.

These products may contain other layers which are conventional in photographic products such as spacing layers, filter layers, antihalo layers, and scavenger layers. The support may be any suitable support used with photographic products. Conventional supports comprise polymer films, paper (including paper coated with polymer), glass, and metal. Research Disclosure, December 1987, No 17643, Section XVII supplies details about bases and auxiliary layers for photographic products.

The preparation of silver halide emulsions is described, for example, in Research Disclosure, No 17643, Sections I and II. Silver halide emulsions may be sensitized chemically in accordance with the methods described in Section III of the Research Disclosure referred to above. According to the invention, blends of emulsions may be made up either by mixing monodisperse emulsions which have been optimally sensitized separately, or by mixing non-sensitized monodisperse emulsions, sensitization being effected on the final blend. The chemical sensitizers generally used are compounds of sulphur and/or selenium and gold. It is also possible to use sensitization by reduction.

The silver halide emulsions and other layers on the photographic products of this invention may contain, as a carrier, hydrophilic colloids, used alone or in combination with other polymeric substances (for example latices). Suitable hydrophilic substances comprise natural substances such as proteins, protein derivatives, cellulose derivatives, for example cellulose esters or gelatin—eg gelatin treated with a base (bovine gelatin, made from bone or hide) or gelatin treated with an acid (pigskin gelatin)—gelatin derivatives, for example acetyl gelatin, phthalyl gelatin, etc, polysaccharides such as dextran, gum arabic, zein, casein, pectin, collagen derivatives, collodion, agar-agar and albumine.

Spectral sensitization methods, or chromatization, are described in the same publication, Section IV. The sensitizing dye may be added at various stages in the preparation of the emulsion, in particular before, during or after chemical sensitization.

Silver halide emulsions may be sensitized spectrally with dyes from various classes, including the class of polymethine dyes, which comprises cyanines, merocyanines, complex cyanines and merocyanines (that is to say tri-, tetra- and polynuclear cyanines and merocyanines), oxonols, hemioxonols, styryls, merostyryls and streptocyanines. The above mentioned Research Disclosure No 17643, Section IV, describes the representative spectral sensitizing dyes.

The photographic products of the invention may contain, amongst other things, optical brighteners, anti-fogging compounds, surfactants, plasticizing agents, lubricants, hardeners, stabilizers, and absorbing and/or scattering agents as described in Sections V, VI, VIII, XI, XII and XVI of the above-mentioned Research Disclosure.

The methods of adding these different compounds and the methods of coating and drying are described in Sections XIV and XV.

According to the invention, the color photographic products comprise, in a conventional manner, at least three components which are respectively blue-, green-, and red-sensitive and which provide respectively the yellow, magenta and cyan components of the subtractive synthesis of the color image.

The products of the invention, after being exposed, undergo photographic treatment comprising silver development of the latent image (black and white development), and then a reversal, which consists of making the residual unexposed silver halide grains developable by means of a fogging exposure or a chemical fogging, and subjecting these fogged silver halide grains to color development in the presence of a color developer and a coupler, the latter generally being incorporated in the reversible product.

The photographic products are then washed, subjected to a bleaching bath and then a fixing bath, before being processed in a stabilizing bath.

Silver development takes place in the presence of a reducing compound which enables the exposed silver halide grains to be converted into metallic silver grains. These compounds are chosen from amongst dihydroxybenzenes such as hydroquinone, 3-pyrazolidones, aminophenols, etc. These compounds may be used alone or in a blend. This first bath may, in addition, contain a stabilizer such as sulphites, a buffer such as carbonates, boric acid, borates or alkanolamines.

The reversal stage is usually effected chemically, either by passing through a fogging bath containing a reducer, or by introducing the fogging agent into the color bath. The fogging substances are, for example, stannous chloride, salts of hydrazine and semicarbazide, ethylenediamine, sodium borohydride, dimethylborane or thiourea dioxide.

The color developer contained in the color development bath, which enables the color image to be obtained, is generally an aromatic primary amine such as the p-phenylenediamines, especially N,N-dialkyl-p-phenylenediamines, whilst the alkyl radicals and aromatic ring may be substituted or otherwise. The p-phenylene-diamines used as chromogenic developers are, for example, N,N-diethyl-p-phenylenediamine monochlorhydrate, 4-N-N-dimethyl-2-methyl phenylenediamine monochlorhydrate or 4-(N-ethyl-N-2-hydroxy ethyl)-2-methylphenylenediamine sulphate. This color development bath may contain other compounds such as stabilizers, development accelerators, which are generally pyridinium compounds, or other compounds.

The main compound in the bleaching bath is an oxidizing compound which transforms the metallic silver into silver ions such as, for example, the alkaline metal salts of a ferric complex of an aminocarboxyl acid, or persulphate compounds.

The bleaching compounds normally used are the ferric complexes of nitrolotriacetic acid, ethylenediamine tetracetic acid, 1,3-propylenediamine tetracetric acid, triethylenetriamine pentacetic acid, ortho-diamino cyclohexane terracetic acid, ethyliminodiacetic acid, etc.

The fixing bath enables the silver halide to be totally converted into a soluble silver complex which is then eliminated from the layers on the photographic product. The compounds used for the fixing are, for example, thiosulphates, such as ammonium or alkaline metal thiosulphates. Stabilizing agents and sequestering agents may be added to the fixing bath.

The bleaching bath and fixing bath may be replaced with a single bleaching/fixing bath. The bleaching accelerator compound is generally present, either in the bleaching bath or in the bleaching/fixing bath. The processing generally comprises a stabilizing bath containing a color stabilizer such as formaldehyde, and a wetting agent.

In the following examples, the color reversible photographic products are exposed and processed in accordance with the standard method for processing Ektachrome E6.

EXAMPLES

It will be possible to judge the invention and its advantages better by referring to the following examples:

EXAMPLE 1

In a 20 liter reactor, 4 liters of deionized water and 57.8 g/l of phthalyl gelatin are introduced. The temperature is raised to 60° C. To this blend are added an anti-foaming agent and a thioether (I) maturation agent of the formula:

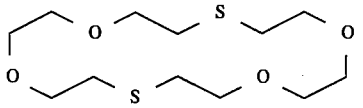

The pAg of the blend is adjusted to 9 with a NaBr solution and the pH to 5.1 with an $HNO_3$, 2N solution.

The nucleation of AgBr microcrystals is effected by introducing, by the double-jet method, a solution of $AgNO_3$ (0.5M) and a solution of NaBr (0.5M) for 70 seconds, under agitation at 3500 rpm. An excess of bromide is kept in the reactor in order to maintain a pAg of 9 at 60° C.

Nucleation is followed by a waiting period of 2 minutes.

A first growth stage of 30 minutes at constant pAg and temperature is then effected, in which the solutions of $AgNO_3$ (2M) and NaBr (2M) are introduced into the reactor in accordance with the accelerated double-jet method.

This first growth stage enables 3.33 moles of silver halides to be precipitated.

A second 29 minute growth stage is then effected at constant pAg and temperature, in which the $AgNO_3$ (2M) and AgBr (2M) solutions are introduced into the reactor by the double-jet method at a constant flow rate of 114.6 ml/min.

In this way a total number of 10 moles of AgBr are obtained. The emulsion is then washed using the flocculation by salting method in which the pH of the emulsion is reduced below the isoelectric point (pH 4).

By varying the quantity of the thioether ripening agent introduced into the reactor before precipitation, the following monodisperse pure bromide emulsions are obtained:

| AgBr | Thioether ripening agent (mg) | ESD (μm) | COV (vol %) |
|---|---|---|---|
| Em (1) | 10 | 0.27 | 21.1 |
| Em (2) | 145 | 0,64 | 11 |
| Em (3) | 300 | 1.10 | 7.7 |
| Em (4) | 40 | 0.37 | 22.5 |

EXAMPLE 2

Preparation of bromoiodide emulsions

The bromoiodide emulsions are prepared in accordance with the operating method described above, except that the two growth stages are effected from a silver nitrate solution (2M) and a NaBr (2M) solution containing KI (3% or 6% molar).

By varying the quantity of the thioether ripening agent introduced into the reactor before precipitation, the following monodisperse bromoiodide emulsions are obtained:

| AgBrI (3 mol %) | Thioether ripening agent (mg) | ESD (μm) | COV (vol %) |
|---|---|---|---|
| Em (5) | 85 | 0.46 | 17.2 |
| Em (6) | 122 | 0.55 | 13.8 |
| Em (7) | 300 | 1.10 | 8.9 |
| Em (8) | 145 | 0.64 | 14.1 |
| Em (9) | 40 | 0.37 | 23.3 |
| Em (10) | 122 | 0.55 | 12.5 |
| Em (11) | 300 | 1.10 | 7.9 |

EXAMPLE 3

Sensitization of the emulsion obtained

The emulsions obtained are optimally sensitized chemically and spectrally.

The emulsions are sensitized chemically with sodium thiosulphate pentahydrate and potassium tetrachloroaurate, in the presence of sodium thiocyanate for 20 minutes at 70° C. Then a sensitizing dye of the following formula is introduced:

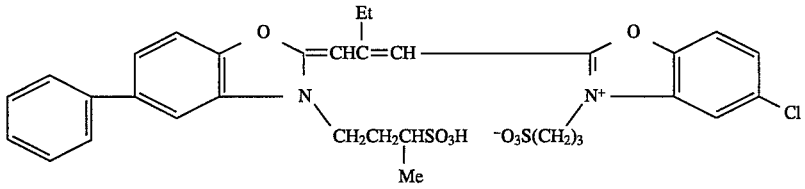

EXAMPLE 4

Preparation and processing of the various blends of emulsions

The blends of emulsions are tested in single-layer format.

The blends of emulsions after chemical and spectral sensitization are coated onto a cellulose triacetate support, with a liter of 0.807 g/m$^2$ of silver. This layer of emulsion is covered with a surface coating of gelatin (2.37 g/m$^2$) containing a tanning agent having the following formula:

$$CH_2{=}CH{-}SO_2{-}CH_2 13\ SO_2{-}CH{=}CH_2$$

The photographic samples are exposed for 1/100 second using an X20 sensitometer equipped with a lamp with a color temperature of 3000° K. The sensitometer is equipped with the following filters: one "5A daylight" filter, "Inconel" filters, and one "Wratten 9" filter.

The samples are exposed through a step tablet comprising 21 incremented graduations of 0.15 Log E.

The samples are then processed in a standard Ektachrome E6 development process which comprises the following steps:

Black and white development in a silver halide Solvent

Washing

Reversal bath

Color development (38° C.)

Washing

Bleaching

Fixing

Washing

Stabilization

For each photographic sample, the following characteristics are measured:

the speed in the shoulder for D1 =Dmax-0.3, the speed D2 for a density of 1, and the speed in the foot for D3 =Dmin+0.2.

In the following examples, the speeds of the blends of emulsions are calculated from the speed of the fast emulsion in the blend, to which the value 100 is allocated.

The granularity is the RMS granularity which takes account of the density fluctuation. The RMS granularity is measured by means of a granularometer with a 48 μm exploration hole under the densitometry conditions defined by the standard ANSI-PH2-19-1976. In the following examples, the granularity is expressed as a granularity unit variation (ΔGU), calculated, taking the fast emulsion of the blend as a reference, by means of the formula:

$$\Delta GU = \mathrm{Log}(\sigma 1/\sigma 2)/\mathrm{Log}(1.05)$$

in which σ1 is the RMS of the emulsion or blend of emulsions in question and σ2 the RMS of the reference emulsion (fast emulsion).

In the following tables, the blends of emulsions are expressed as a percentage of grains with respect to the total number of silver halide grains.

Example 4.1 (invention)

In the following table, the fast emulsion is a AgBrI (3%) emulsion and the slow emulsion is a AgBr emulsion. The blends (I) and (II) are obtained from Era(8) and Em(4).

TABLE 1

| | | | | Speed | | | |
|---|---|---|---|---|---|---|---|
| | Fast | Medium | Slow | D1 | D2 | D3 | ΔGU |
| Em (8) | 100 | — | 0 | 100 | 100 | 100 | Control |

TABLE 1-continued

| | | | | Speed | | | |
|---|---|---|---|---|---|---|---|
| | Fast | Medium | Slow | D1 | D2 | D3 | ΔGU |
| Em (4) | 0 | — | 100 | 77 | 78 | 90 | +1.6 |
| I | 34 | — | 66 | 105 | 107 | 113 | 0 |
| II | 16 | — | 84 | 105 | 107 | 118 | 0 |

These results show that the presence of a slow pure bromide emulsion in a blend of two emulsions results in a surprising increase in sensitivity. In fact, it can be observed that the speed of the blend is higher than the speed of the fast emulsion.

Example 4.2 (invention)

In the following table, the fast emulsion is a AgBrI (6%) emulsion, the medium emulsion is a AgBrI (3%) emulsion and the slow emulsion is a AgBr emulsion. The blends IV to VII are obtained from Em(11) , Em (6), and Em(1) .

TABLE 2

| | | | | Speed | | | |
|---|---|---|---|---|---|---|---|
| | Fast | Medium | Slow | D1 | D2 | D3 | ΔGU |
| Em (11) | 100 | 0 | 0 | 100 | 100 | 100 | Control |
| Em (6) | 0 | 100 | 0 | 92 | 85 | 81 | −16.4 |
| Em (1) | 0 | 0 | 100 | 77 | 78 | 89 | −12.9 |
| IV | 15 | 55 | 30 | 104 | 101 | 94 | −8.4 |
| V | 15 | 45 | 40 | 106 | 100 | 95 | −5.6 |
| VI | 10 | 10 | 80 | 103 | 102 | 100 | −3.2 |
| VII | 5 | 10 | 85 | 108 | 104 | 101 | −4.8 |

In the following table the fast emulsion and medium emulsion are AgBrI (6%) emulsions, and the slow emulsion is a AgBr emulsion. The blends IX to XII are obtained from Em(11), Em(10), and Em(4).

TABLE 3

| | | | | Speed | | | |
|---|---|---|---|---|---|---|---|
| | Fast | Medium | Slow | D1 | D2 | D3 | ΔGU |
| Em (11) | 100 | 0 | 0 | 100 | 100 | 100 | Control |
| Em (10) | 0 | 100 | 0 | 86 | 76 | 73 | −16.3 |
| Em (4) | 0 | 0 | 100 | 81 | 78 | 93 | −15.7 |
| IX | 10 | 40 | 50 | 107 | 101 | 91 | −10.6 |
| X | 10 | 30 | 60 | 108 | 104 | 95 | −7.5 |
| XI | 10 | 20 | 70 | 109 | 105 | 96 | −4.9 |
| XII | 10 | 10 | 80 | 109 | 110 | 99 | −1.6 |

In the above examples, a surprising increase in the speed of the blend can be seen. This increase in sensitivity does not occur to the detriment of the granularity. It can be seen that this increase in the speed of the blend is greater for D1 than for D3.

Example 4.3 (invention)

In the following table the fast emulsion is a AgBrI (6%) emulsion, whilst the medium emulsion and the slow emulsion are AgBr emulsions. The blend VIII is obtained from Em(11), Em(2), and Em(1).

TABLE 4

| | Fast | Medium | Slow | Speed D1 | D2 | D3 | ΔGU |
|---|---|---|---|---|---|---|---|
| Em (11) | 100 | 0 | 0 | 100 | 100 | 100 | Control |
| Em (2) | 0 | 100 | 0 | 93 | 92 | 115 | −8.7 |
| Em (1) | 0 | 0 | 100 | 79 | 74 | 93 | −14.2 |
| VIII | 15 | 55 | 30 | 100 | 100 | 107 | −6.8 |

In the following table the fast emulsion is a AgBr emulsion, the medium emulsion is a AgBrI (3%) emulsion and the slow emulsion is a AgBr emulsion. The blend III is obtained from Em(3), Em(6), and Em(1).

TABLE 5

| | Fast | Medium | Slow | Speed D1 | D2 | D3 | ΔGU |
|---|---|---|---|---|---|---|---|
| Em (3) | 100 | 0 | 0 | 100 | 100 | 100 | Control |
| Em (6) | 0 | 100 | 0 | 98 | 86 | 79 | −17.8 |
| Em (1) | 0 | 0 | 100 | 84 | 74 | 79 | −15.2 |
| III | 15 | 45 | 40 | 108 | 106 | 104 | −3.4 |

It can be seen that the speeds D1, D2, and D3 of the blends described above are equal to or greater than the values obtained for the fast emulsion.

Example 4.5 (comparison)

In the following table the emulsions are AgBrI (3%) emulsions. The blends XIII to XV are obtained from Em(7), Era(8), and Em(9).

TABLE 6

| | Fast | Medium | Slow | Speed D1 | D2 | D3 | ΔGU |
|---|---|---|---|---|---|---|---|
| Em (7) | 100 | 0 | 0 | 100 | 100 | 100 | Control |
| Em (8) | 0 | 100 | 0 | 95 | 88 | 91 | −14 |
| Em (9) | 0 | 0 | 100 | 83 | 74 | 88 | −21 |
| XIII | 33 | 33 | 33 | 97 | 90 | 89 | −3.2 |
| XIV | 25 | 50 | 25 | 100 | 89 | 88 | −3.9 |
| XV | 3 | 11 | 85 | 97 | 88 | 86 | −8.8 |

The speeds D1, D2 and D3 for the blends of emulsions which do not contain pure bromide emulsions are, in all cases, lower than the speeds of the blends of the invention, even when the proportion of fast emulsion grains in the blend is as high at 33%.

In the above blends of emulsions, an improvement in granularity is obtained which is solely due to the replacement of part of a fast emulsion with an emulsion consisting of silver halide grains with smaller sizes and therefore of lower sensitivity.

Example 4.6 (invention)

In the following table the fast emulsion is a AgBrI (6%) emulsion, the medium emulsion is a AgBr emulsion and the slow emulsion is a AgBrI (3%) emulsion. The blend XVI is obtained from Em(11), Em(2), and Em(5). The sensitivities obtained are improved compared with the sensitivities obtained with the bromoiodide blends of Example 4.5.

TABLE 7

| | Fast | Medium | Slow | Speed D1 | D2 | D3 | ΔGU |
|---|---|---|---|---|---|---|---|
| Em (11) | 100 | 0 | 0 | 100 | 100 | 100 | Control |
| Em (2) | 0 | 100 | 0 | 95 | 94 | 109 | −7.9 |
| Em (5) | 0 | 0 | 100 | 82 | 72 | 77 | −18.8 |
| XVI | 15 | 55 | 30 | 103 | 97 | 98 | −7.7 |

Example 4.7 (Comparison)

In the following table, the fast emulsion is a AgBrI (6%) emulsion, the medium emulsion is a AgBrI (3%) emulsion and the slow emulsion is a AgBr emulsion. The blend XVII is obtained from Em(11), Em(6), and Era(4).

TABLE 8

| | Fast | Medium | Slow | Speed D1 | D2 | D3 | ΔGU |
|---|---|---|---|---|---|---|---|
| Em (11) | 100 | 0 | 0 | 100 | 100 | 100 | Control |
| Em (6) | 0 | 100 | 0 | 92 | 82 | 81 | −16.4 |
| Em (4) | 0 | 0 | 100 | 77 | 75 | 89 | −12.9 |
| XVII | 10 | 70 | 20 | 100 | 90 | 85 | −11.2 |

These results show that the proportion of slow emulsion grains should preferably be greater than 20%.

The invention has been described in detail with particular reference to preferred embodiments thereof, but it will be understood that variations and modifications can be effected within the spirit and scope of the invention.

We claim:

1. A reversal photographic product comprising at least one light sensitive silver halide emulsion layer consisting of a blend of monodisperse silver halide emulsions comprising at least one each of a fast silver halide emulsion and one slow silver halide emulsion, and optionally comprising a medium silver halide emulsion characterized in that 1) at least one of the emulsions making up the blend is a pure bromide emulsion and at least one of the emulsions making up the blend is a bromoiodide emulsion, 2) the proportion of fast emulsion grains in the blend wherein said at least one slow emulsion is a pure bromide emulsion is less than 40% and 3) the proportion of slow emulsion grains in the blend is greater than 20% based on the total grain number in said blend.

2. Photographic product according to claim 1, in which the proportion of fast emulsion is less than 20% based on the total grain number in said blend.

3. The product of claim 3 wherein said monodisperse silver halide emulsions have a coefficient of variation of less than 25%.

4. Photographic product of claim 3 wherein the difference in speed between any two emulsions of the blend having the nearest sensitivities is within the range of from about 0.2 to about 1 log E.

5. Photographic product according to claim 1, in which the distribution of silver halides in the bromoiodide emulsion is homogeneous.

6. Photographic product according to claim 1, comprising

16% of fast bromoiodide emulsion containing 3% molar iodide, and

84% slow pure bromide emulsion.

7. Photographic product according to claim 1, comprising:

34% fast bromoiodide emulsion containing 3% molar iodide, and

66% slow pure bromide emulsion.

8. Photographic product according to claim 1, comprising:

15% fast bromoiodide emulsion containing 6% molar iodide,

55% medium bromoiodide emulsion containing 3% molar iodide, and

30% slow pure bromide emulsion.

9. Photographic product according to claim 1, comprising:

15% fast bromoiodide emulsion containing 6% molar iodide,

45% medium bromoiodide emulsion containing 3% molar iodide, and

40% slow pure bromide emulsion.

10. Photographic product according to claim 1, comprising:

10% fast bromoiodide emulsion containing 6% molar iodide,

30% medium bromoiodide emulsion containing 6% molar iodide, and

60% slow pure bromide emulsion.

11. Photographic product according to claim 1, comprising:

10% fast bromoiodide emulsion containing 6% molar iodide,

40% medium bromoiodide emulsion containing 6% molar iodide, and

50% slow pure bromide emulsion.

12. Photographic product according to claim 1, comprising:

10% fast bromoiodide emulsion containing 6% molar iodide,

20% medium bromoiodide emulsion containing 6% molar iodide, and

70% slow pure bromide emulsion.

13. Photographic product according to claim 1, comprising:

5% fast bromoiodide emulsion containing 6% molar iodide,

10% medium bromoiodide emulsion containing 3% molar iodide, and

85% slow pure bromide emulsion.

14. Photographic product according to claim 1, comprising:

10% fast bromoiodide emulsion containing 6% molar iodide,

10% medium bromoiodide emulsion containing 3% molar iodide, and

80% slow pure bromide emulsion.

15. Photographic product according to claim 1, comprising:

10% fast bromoiodide emulsion containing 6% molar iodide,

10% medium bromoiodide emulsion containing 6% molar iodide, and

80% slow pure bromide emulsion.

16. Photographic product according to claim 1, comprising:

15% fast pure bromide emulsion,

45% medium bromoiodide emulsion containing 3% molar iodide, and

40% slow pure bromide emulsion.

17. Photographic product according to claim 1, comprising:

15% fast bromoiodide emulsion containing 6% molar iodide,

55% medium pure bromide emulsion, and

30% slow bromoiodide emulsion containing 3% molar iodide.

18. Photographic product according to claim 1, comprising:

15% fast bromoiodide emulsion containing 6% molar iodide,

55% medium pure bromide emulsion, and

30% slow pure bromide emulsion.

19. The photographic product of claim 1 wherein the difference in speed between any two emulsions of the blend having the nearest sensitivities is within the range of from about 0.2 to about 1 Log E (E being exposure) and the extended latitude in the photographic element is achieved without an appreciable distortion of the shape of the sensitometric curve.

20. Photographic product of claim 1 wherein the mean equivalent diameter of the grains in each of the emulsions making up the blend is between 0.2 and 1.5 micrometer.

21. The reversal photographic element of claim 1 wherein the iodide content of said bromoiodide emulsion is between 0.5 and 20 mol %.

22. Photographic product according to claim 1, in which the total proportion of iodide in the blend of emulsions is between 1 and 6%.

23. The product of claim 1 wherein said at least one fast silver halide emulsion is a bromoiodide emulsion.

* * * * *